US005957518A

United States Patent [19]

Elliott

[11] Patent Number: 5,957,518

[45] Date of Patent: Sep. 28, 1999

[54] GARMENT CARRIER

[76] Inventor: Glenwrick A. Elliott, P.O. Box 351176, Palm Coast, Fla. 32135

[21] Appl. No.: 09/130,776

[22] Filed: Aug. 7, 1998

[51] Int. Cl.[6] ..... A47G 25/06

[52] U.S. Cl. ..... 294/142; 224/265; 294/15; 294/26; 294/146

[58] Field of Search ..... 294/15, 26, 137, 294/141–143, 146, 150, 156, 170, 171; 223/85, 88; 224/255, 257, 265, 927

[56] References Cited

U.S. PATENT DOCUMENTS

| | | | |
|---|---|---|---|
| 2,594,228 | 4/1952 | Smith | 294/143 X |
| 2,598,643 | 5/1952 | Kaplan et al. | 294/143 X |
| 2,728,503 | 12/1955 | Kramer | 294/143 X |
| 3,162,473 | 12/1964 | George | 294/15 X |
| 3,313,460 | 4/1967 | Hooker | 294/143 X |
| 3,549,065 | 12/1970 | Schubert | 294/143 |
| 3,584,772 | 6/1971 | Robertson | 294/156 X |
| 3,606,967 | 9/1971 | Roberts | 294/150 X |
| 3,759,430 | 9/1973 | Ward | 224/927 X |
| 3,848,787 | 11/1974 | Hill | 294/141 |
| 3,935,976 | 2/1976 | Mizrach | 223/88 |
| 4,030,649 | 6/1977 | Potoroka | 294/149 |
| 4,824,156 | 4/1989 | Greene | 294/142 |
| 4,940,174 | 7/1990 | Parker | 294/141 X |

*Primary Examiner*—Johnny D. Cherry
*Attorney, Agent, or Firm*—Dunlap, Codding & Rogers, P.C.

[57] ABSTRACT

A device for use by an individual for carrying garments hung on hangers is provided. The device includes a straight shaft member entirely padded having a hanger receiving hook at one end and a hand grip at the opposite end thereof. The hanger receiving hook is swingably movable relative to the straight tubular shaft and is capable of receiving the hook portion of a garment hanger. A tubular money holder that is smaller in diameter than the shaft member is insertable within one end of the straight shaft member.

14 Claims, 3 Drawing Sheets

GARMENT CARRIER

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates generally to a garment carrier, and more particularly, but not by way of limitation, to an improved apparatus for use by an individual to carry garments hung on garment hangers.

2. Description of Related Art

Garments are often hung on hangers to facilitate storage on rods and hooks. When transporting hung garments, such as when travelling, the hung garments are typically carried by placing the garments over one's shoulder and grasping the hook portion of the hanger with the corresponding hand. Carrying hung garments in this manner requires the carrier to raise his hand near the shoulder and twist the hand and wrist in an awkward and uncomfortable position. Further, carrying garments by grasping the hanger is uncomfortable on the hands and fingers particularly where more than one garment is to be carried.

An additional problem experienced when carrying hung garments is that when an individual needs a rest or requires the use of his hands, such as when presenting a ticket or purchasing goods, the most convenient location to place the garments is on the floor where the garments can become soiled and wrinkled.

Several devices have been proposed for carrying hung garments. One such device is disclosed in U.S. Pat. No. 3,848,787, issued to Hill. The Hill patent discloses a rigid angled bar with multiple contact points at one end, a grip for holding the device at the other end, and a pad at the point where the bar optimally contacts the user's shoulder. The angularity of the Hill structure is bulky by nature thus making storage problematic. In addition, this structure requires the user to maintain his grip on the device at all times to prevent the device from becoming unbalanced and falling off the user's shoulder. To overcome this drawback, the Hill patent does disclose the use of an anchoring element in the form of a cord and hook attached to the hand grip. The anchoring element is intended for engaging the belt of an individual so that the individual is permitted to release his hands from the hand grip. The problem with the anchoring element of Hill is that it requires the user to be wearing a belt or some article of clothing with a means for attaching the hook. Not all articles of clothing are provided with such a means and frequently individuals do not desire to attach a hook to their clothing in that this may result in damage to the clothing to which the hook is attached.

Another device is disclosed in U.S. Pat. No. 4,824,156, issued to Greene. The Greene device is small in totality and is provided with a small handle with wire extending forward from the edges of the handle and perpendicular thereto forming a hook element adjacent the handle. Holding the handle of the Greene device, the user must extend the arm on top of or behind the user's shoulder. While this device is simple in construction, it does not eliminate the discomfort associated with transporting hung garments.

Yet another device is disclosed in U.S. Pat. No. 3,759,430, issued to Ward. The Ward device provides a flexible belt-like configuration for laying over the shoulder of the user with the hangers attached to the end of the belt which lays on the user's back. Similar to the Greene device discussed above, this device is ergonomically inefficient. The user of the device must pull down or create leverage on a handle which rests against the chest of the user.

Accordingly, a need exists for an improved garment carrier that is small and lightweight for easy use and convenient storage, and yet is ergonomic so as to maximize the user's comfort and convenience during use.

SUMMARY OF THE INVENTION

In one aspect, the present invention is directed to a garment carrier for carrying one or more garments hung on garment hangers. The garment carrier includes a straight shaft member having a first end and a second end. The first end of the shaft defines a hand grip. A hanger receiving hook adapted to receive the hook portion of garment hangers is provided on the second end of the shaft.

The hanger receiving hook is swingably movable relative to the shaft member at a pivot point so that the garments hung on the hanger received on the hanger receiving hook hang freely substantially adjacent the individual's back when the shaft member is positioned on the individual's shoulder and the hand grip is grasped by the individual and so that the garments hung on the hanger received on the hanger receiving hook cooperate with the shaft member and the hanger receiving hook such that the garments hung on the hanger received on the hanger receiving hook hang freely substantially adjacent the individual's back and the shaft member hangs freely substantially adjacent the individual's front upon the pivot point being positioned on the individual's shoulder and the individual releasing the hand grip whereby the shaft functions as a counterbalance to support the garments adjacent the individual's back without requiring the individual to support the shaft with the individual's hand.

Objects, features, and advantages of the present invention will be apparent to those skilled in the art from the following detailed description when read in conjunction with the accompanying drawings and appended claims.

DETAILED DESCRIPTION OF THE INVENTION

Figure 1:
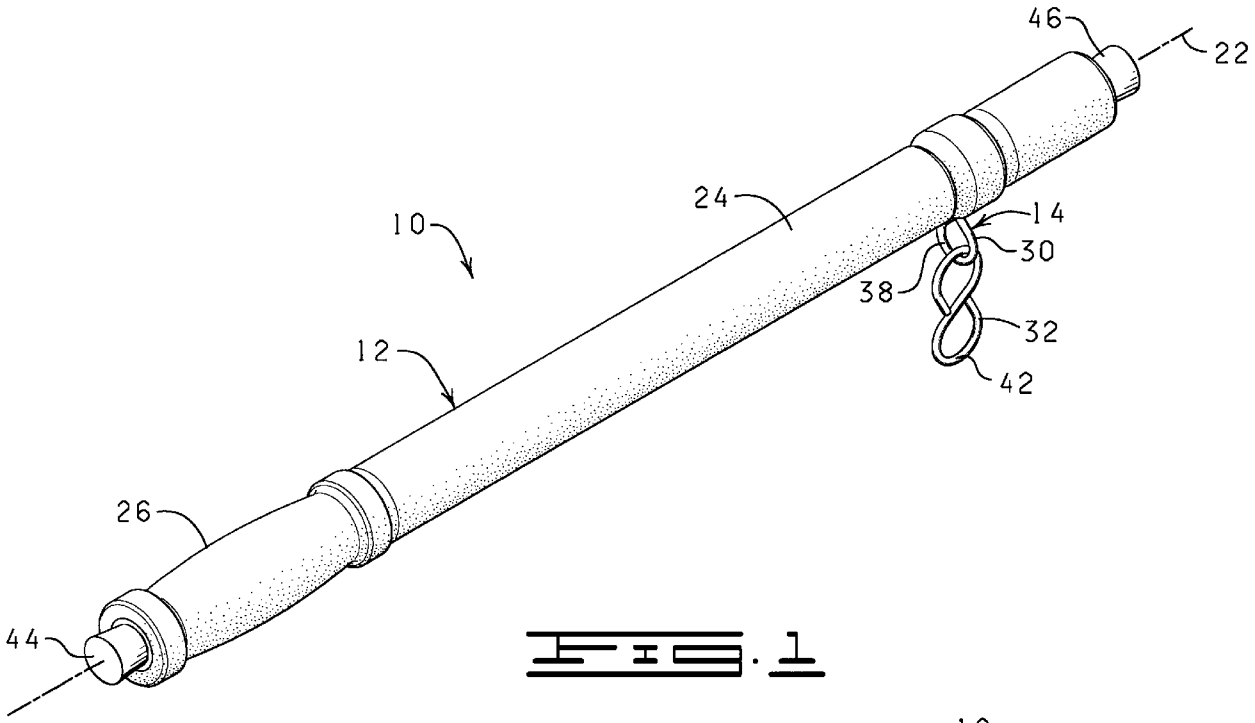
FIG. 1 is a perspective view of a garment carrier constructed in accordance with the present invention.
Figure 2:
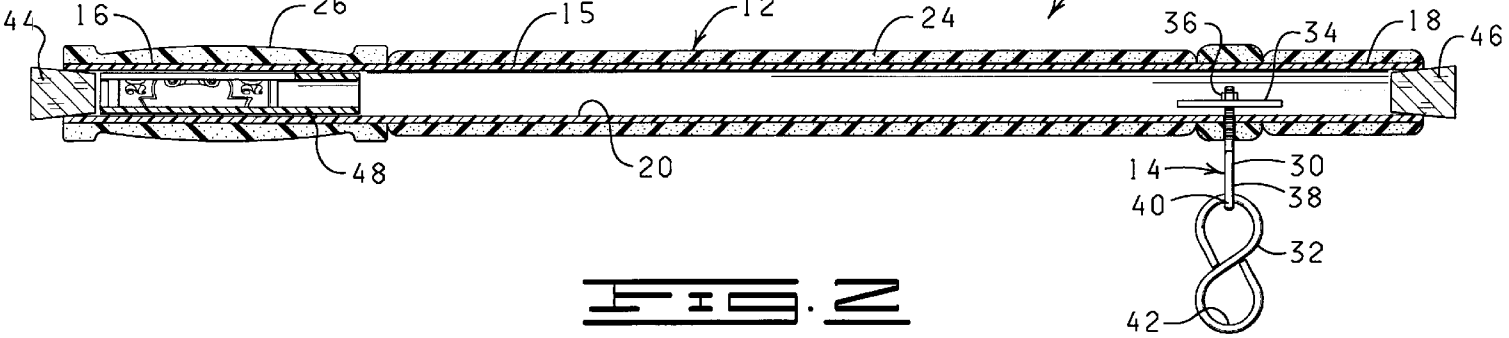
FIG. 2 is a cross-sectional view of the garment carrier of the present invention.

Referring now to the drawings, and more particularly to FIGS. 1 and 2, a garment carrier 10 constructed in accordance with the present invention is illustrated. The garment carrier 10 of the present invention is a simple but effective device used by an individual to carry garments hung on garment hangers.

The garment carrier 10 broadly includes a shaft assembly 12 and a hanger receiving hook assembly 14 connected to the shaft assembly 12 near one end thereof. The shaft assembly 12 includes a shaft member 15 constructed of rigid and lightweight material, such as a tubular metal or polymeric material. The shaft member 15 is characterized as having a first end 16, a second end 18, and an interior chamber 20 which extends through the shaft member 15 from the first end 16 to the second end 18. The first end 16 of the shaft member 15 defines a hand grip dimensioned to be gripped by a hand of an individual such that the individual's fingers are positioned substantially normal to a longitudinal axis 22 of the shaft member 15 when the individual's fingers are gripped about the hand grip in a manner discussed below.

The shaft member 15 can be formed to have any length such that the shaft member 15 is positionable on an individual's shoulder with the first end 16 of the shaft member 15 positioned so that an individual may easily grasp the first end 16 of the shaft member 15 without requiring the individual to rotate his arm and hand in an awkward position and with the second end 18 extended over the back of the individual. A preferable length of the shaft member 15 is in a range from about 18 inches to 24 inches. However, it will be appreciated that the most efficient length of the shaft member 15 will depend on the size of the individual using the garment carrier 10.

The shaft member 15 is covered with a resilient padding 24 extending from the second end 18 a distance toward the first end 16. The shaft member 15 is further provided with a resilient hand grip 26 over the first end 16 of the shaft member 15. It will be appreciated that the padding 24 and the hand grip 26 may be provided in various colors and textures to provide various decorative effects for the garment carrier 10.

The hanger receiving hook assembly 14 is attached to the shaft member 15 approximate the second end 18 thereof and is adapted to receive the hook portion of a conventional garment hanger having a hook portion. The hanger receiving hook assembly 14 includes an eye bolt 30, a hanger receiving hook 32, a brace 34, and a nut 36. The eye bolt 30 is attached to the shaft member 15 with the brace 34 and the nut 36 such that a looped portion 38 of the eye bolt 30 extends outwardly from the shaft member 15. The hanger receiving hook 32 is attached to the looped portion 38 of the eye bolt 30 such that the hanger receiving hook 32 is swingably movable relative to the shaft member 15 at a pivot point 40. The hanger receiving hook 32 is further attached to the eye bolt 30 such that a hanger receiving opening 42 defined by the hanger receiving hook 32 is oriented in a substantially normal relationship with respect to the longitudinal axis 22 of the shaft member 15.

The first end 16 and the second end 18 of the shaft member 15 are covered with an end cap 44 and an end cap 46, respectively. The ends caps 44 and 46 can be any suitable device insertable into the shaft member 15 for enclosing the interior chamber 20 of the shaft member 15. For example, the end caps 44 and 46 may be fabricated of a rubber or cork material.

The advantage of enclosing the interior chamber 20 of the shaft member 15 is that the interior chamber 20 may be used as a storage space. In particular, FIG. 2 illustrates a money holder 48 disposed in the interior chamber 20. The money holder 48 may be removed from the interior chamber 20 by removing the end cap 44 from the first end 16 of the shaft member 15 and sliding the money holder 48 from the interior chamber 20.

Figure 3:
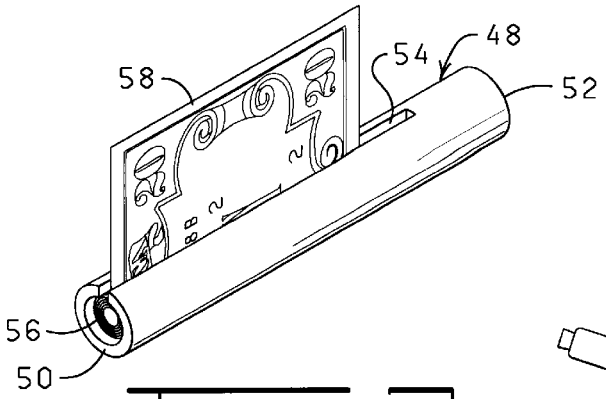
FIG. 3 is a perspective view of a money holder for use with the garment carrier of the present invention.

As best shown in FIG. 3, the money holder 48 is a tubular member, preferably constructed of a lightweight material, having a diameter less than the diameter of the interior chamber 20 of the shaft member 15 such that the money holder 48 is capable of being slidably inserted into and removed from the interior chamber 20 of the shaft member 15. The money holder 48 has a first open end 50, a second end 52, and a slot 54 extending from the first open end 50 a distance toward the second end 52. The slot 54 extends through the money holder 48 to the interior thereof. The interior of the money holder 48 is dimensioned to accommodate the insertion and removal of a roll of material, such as a roll of currency 56. The roll of currency 56 is disposed in the money holder 48 by inserting the roll of currency 56 into the interior of the money holder 48 through the first open end 50 thereof. The slot 54 allows individual bills of the roll of currency 56, such as bill 58, to be removed from the roll of currency 56 without requiring the removal of the entire roll of currency 56 from the money holder 48.

Figure 4:
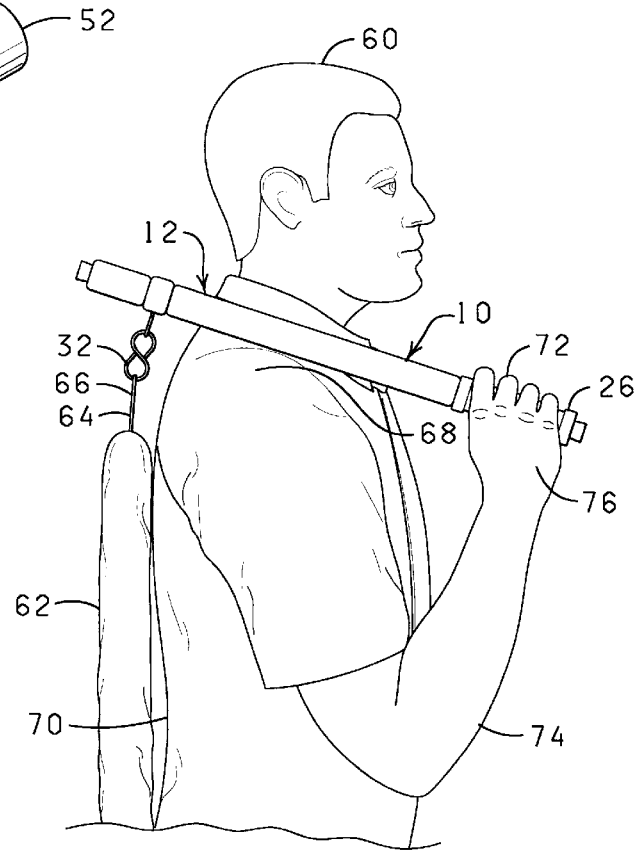
FIG. 4 is a side elevational view of an individual shown grasping the garment carrier of the present invention with the arm and hand in a natural position.
Figure 5:
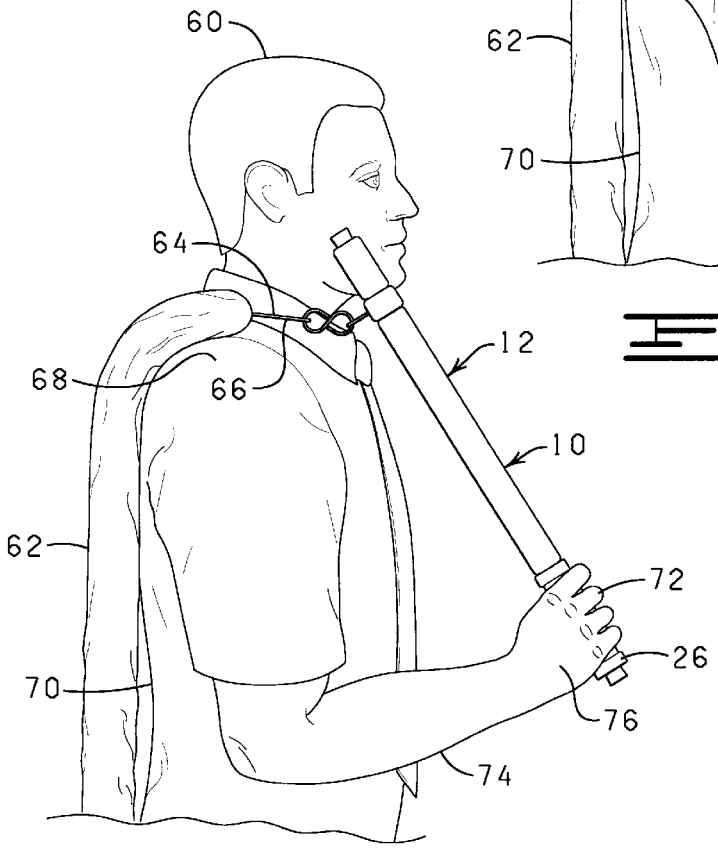
FIG. 5 is a side elevational view of the individual of FIG. 4 illustrating the individual grasping the garment carrier of the present invention with the arm and hand in a natural position with the garment carrier positioned in a different position relative to the position illustrated in FIG. 4.

FIGS. 4 and 5 illustrate the use of the garment carrier 10 by an individual 60 to carry garments 62 hung on garment hangers 64. More specifically, FIG. 4 illustrates one mode of use of the garment carrier 10, and FIG. 5 illustrates another mode of use of the garment carrier 10. In use, a hook portion 66 of the garment hangers 64 is hung on the hanger receiving hook 32 to carry the garments 62 with the garment carrier 10. The shaft assembly 12 may then be supported on the individual's shoulder 68, as illustrated in FIG. 4, while the garments 62 hang freely adjacent the individual's back 70 and the hand grip 26 is grasped by the individual 60 with the fingers 72 of the individual 60 positioned substantially normal to the longitudinal axis 22 of the shaft member 15 whereby the individual's arm 74 and hand 76 are in a natural position.

Alternatively, the hook portion 66 of the garment hangers 64 may be supported on the individual's shoulder 68 with the shaft assembly 12 in a non-engaging position relative to the individual's shoulder 68, as illustrated in FIG. 5. In this instance, the garments 62 again hang freely adjacent the individual's back 70 and the hand grip 26 is grasped by the individual 60 with the fingers 72 of the individual 60 positioned substantially normal to the longitudinal axis 22 of the shaft member 15 whereby the individual's arm 74 and hand 76 are in a natural position.

Figure 6:
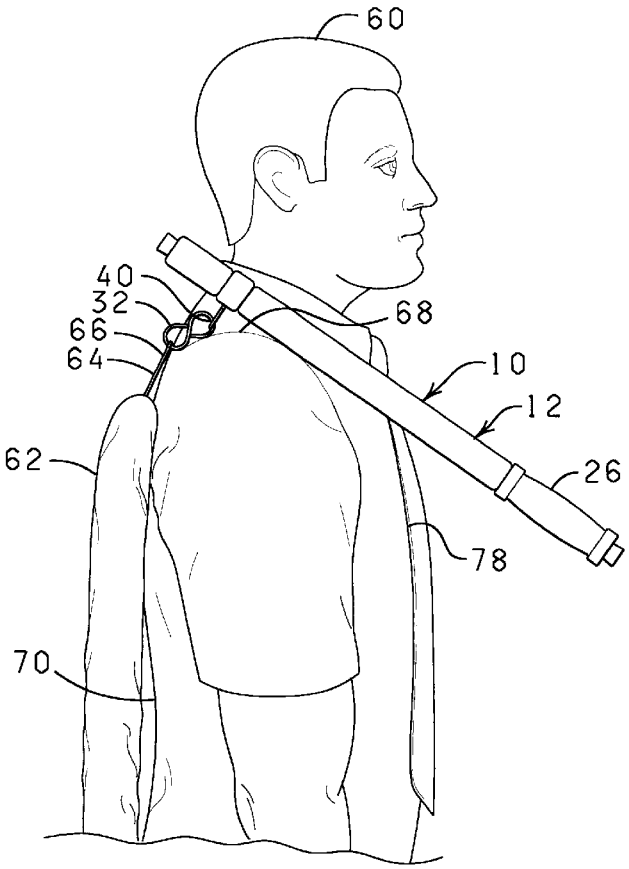
FIG. 6 is a side elevational view of the individual of FIG. 4 with the garment carrier of the present invention balanced over the shoulder of the individual while the garments hung thereon lay over the back of the individual's shoulder.

FIG. 6 illustrates another mode of use of the garment carrier 10 for carrying the garments 62. That is, in certain situations, the individual 60 may desire to release the hand grip 26 of the garment carrier 10 periodically so that the individual 60 may have the use of both of the individual's hands or merely to move the individual's arm to another position. In this instance, the individual 60 may position the pivot point 40 of the hanger receiving hook 32 relative to the shaft assembly 12 over the individual's shoulder 68 as illustrated in FIG. 6. The pivot connection between the hanger receiving hook 32 and the shaft assembly 12 permits the garments 62 hung on the hanger receiving hook 32 to hang freely adjacent the individual's back 70 and the shaft assembly 12 to hang freely substantially adjacent the individual's front 78. In this position, the shaft assembly 12 functions as a counterbalance to support the garments 62 adjacent the individual's back 70 without requiring the individual to support the shaft assembly 12 with the individual's hand 76.

Figure 7:
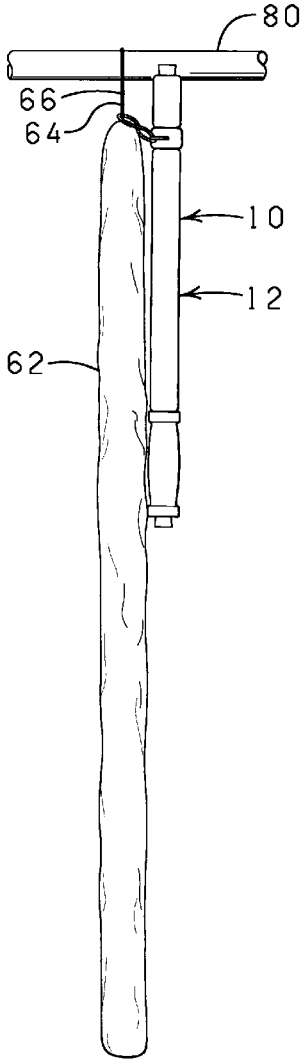
FIG. 7 is a side elevational view of the garment carrier of the present invention and the garments hung on a rod.

Accordingly, one of the advantages of the garment carrier 10 of the present invention is that the garments 62 attached to the garment carrier 10 are able to be supported by the garment carrier 10 even though the individual 60 is not grasping the garment carrier 10 with his hands. Furthermore, when the individual 60 is grasping the garment carrier 10, the individual's arm 74 and hand 76 are placed in a natural and comfortable position. Finally, as illustrated in FIG. 7, another advantage of the garment carrier 10 of the present invention is that the linear configuration of the shaft assembly 12 permits the garment carrier 10 to hang freely adjacent to the garments 62 so as not to significantly protrude from the garments 62 when the garments 62 are hung on a rod or hook 80 in a conventional manner.

From the above description it is clear that the present invention is well adapted to carry out the objects and to attain the advantages mentioned herein as well as those inherent in the invention. While a presently preferred embodiment of the invention has been described for purposes of this disclosure, it will be understood that numerous changes may be made which will readily suggest themselves to those skilled in the art and which are accomplished within the spirit of the invention disclosed and as defined in the appended claims.

What is claimed is:

1. An apparatus for use by an individual to carry garments hung on hangers having a hook portion, comprising:

a shaft member having a first end and a second end, the first end defining a hand grip dimensioned to be gripped with a hand of the individual such that the individual's fingers are positioned substantially normal to a longitudinal axis of the shaft member when the individual's fingers are gripped about the hand grip; and a hanger receiving hook adapted to receive the hook portion of at least one hanger and attached to the shaft member proximate the second end thereof such that the hanger receiving hook is swingably movable relative to the shaft member at a pivot point so that the garments hung on the hanger received on the hanger receiving hook hang freely substantially adjacent the individual's back when the shaft member is positioned on the individual's shoulder and the hand grip is grasped by the individual and so that the garments hung on the hanger received on the hanger receiving hook cooperate with the shaft member and the hanger receiving hook such that the garments hung on the hanger received on the hanger receiving hook hang freely substantially adjacent the individual's back and the shaft member hangs freely substantially adjacent the individual's front upon the pivot point being positioned on the individual's shoulder and the individual releasing the hand grip whereby the shaft member functions as a counterbalance to support the garments adjacent the individual's back without requiring the individual to support the shaft member with the individual's hand.

2. The apparatus of claim 1 wherein the shaft member is straight.

3. The apparatus of claim 1 wherein the shaft member is covered with a resilient padding.

4. The apparatus of claim 1 wherein the shaft member is at least partially hollow at one end thereof, and wherein the apparatus further comprises:

means slidingly positionable within the hollow portion of the shaft member for holding a roll of paper currency; and means for retaining the holding means in the hollow portion of the shaft member.

5. The apparatus of claim 4 wherein the holding means comprises:

a tubular member having a first end, a second end, and a slot extending from the first end toward the second end.

6. An apparatus for use by an individual to carry garments hung on hangers having a hook portion, comprising:

a straight shaft member covered with a resilient padding having a first end and a second end, the first end defining a hand grip dimensioned to be gripped with a hand of the individual such that the individual's fingers are positioned substantially normal to a longitudinal axis of the shaft member when the individual's fingers are gripped about the hand grip; and a hanger receiving hook adapted to receive the hook portion of at least one hanger and attached to the shaft member proximate the second end thereof such that the hanger receiving hook is swingably movable relative to the shaft member at a pivot point so that the garments hung on the hanger received on the hanger receiving hook hang freely substantially adjacent the individual's back when the shaft member is positioned on the individual's shoulder and the hand grip is grasped by the individual and so that the garments hung on the hanger received on the hanger receiving hook cooperate with the shaft member and the hanger receiving hook such that the garments hung on the hanger received on the hanger receiving hook hang freely substantially adjacent the individual's back and the shaft member hangs freely substantially adjacent the individual's front upon the pivot point being positioned on the individual's shoulder and the individual releasing the hand grip whereby the shaft member functions as a counterbalance to support the garments adjacent the individual's back without requiring the individual to support the shaft member with the individual's hand.

7. The apparatus of claim 6 wherein the shaft member is at least partially hollow at one end thereof, and wherein the apparatus further comprises:

means slidingly positionable within the hollow portion of the shaft member for holding a roll of paper currency; and means for retaining the holding means in the hollow portion of the shaft member.

8. The apparatus of claim 7 wherein the holding means comprises:

a tubular member having a first end, a second end, and a slot extending from the first end toward the second end.

9. An apparatus for use by an individual to carry garments hung on hangers having a hook portion, comprising:

a shaft member having a first end and a second end, the first end defining a hand grip dimensioned to be gripped with a hand of the individual such that the individual's fingers are positioned substantially normal to a longitudinal axis of the shaft member when the individual's fingers are gripped about the hand grip, the shaft member being at least partially hollow at one end thereof;

a hanger receiving hook adapted to receive the hook portion of at least one hanger and attached to the shaft member proximate the second end thereof;

means slidingly positionable within the hollow portion of the shaft member for holding a roll of paper currency; and means for retaining the holding means in the hollow portion of the shaft member.

10. The apparatus of claim 9 wherein the holding means comprises:

a tubular member having a first end, a second end, and a slot extending from the first end toward the second end.

11. The apparatus of claim 10 wherein the shaft member is straight.

12. The apparatus of claim 11 wherein the shaft member is covered with a resilient padding.

13. A method for an individual to carry garments hung on hangers having a hook portion comprising:

attaching the garments hung on the hangers to a hanger receiving hook adapted to receive the hook portion of at least one hanger swingably attached to a shaft member so as to form a pivot point, the shaft member having a first end and a second end, and grasping a hand grip on the first end with a hand of the individual such that the individual's fingers are positioned substantially normal to a longitudinal axis of the shaft member while the individual's fingers are gripped about the hand grip; and positioning the pivot point between the shaft member and the hanger receiving hook on the individual's shoulder such that the garments hung on hangers hang freely substantially adjacent to the individual's back and the shaft member hangs freely substantially adjacent the individual's front whereby the shaft member functions as a counterbalance to support the garments adjacent the individual's back without requiring the individual to support the shaft member with the individual's hand.

14. A method for an individual to carry garments hung on hangers having a hook portion comprising:

attaching the garments hung on the hangers to a hanger receiving hook adapted to receive the hook portion of at least one hanger swingably attached to a shaft member having a first end and a second end, and defining a hand grip on the first end dimensioned such that the individual's fingers are positionable substantially normal to a longitudinal axis of the shaft member while the individual's fingers are gripped about the hand grip;

positioning the garments hung on the hangers received by the hanger receiving hook such that the garments hung on hangers hang freely substantially adjacent to the individual's back with the hand grip positioned forward of the individual's shoulder; and grasping the hand grip such that the fingers of the individual are positioned substantially normal to the longitudinal axis of the shaft member.

* * * * *